United States Patent [19]

Hofman

[11] Patent Number: 4,524,737

[45] Date of Patent: Jun. 25, 1985

[54] FUEL INJECTION APPARATUS WITH AN AUXILIARY PUMP FOR PILOT AND MAIN INJECTION

[75] Inventor: Eberhard Hofman, Kirchberg, Fed. Rep. of Germany

[73] Assignee: Robert Bosch GmbH, Stuttgart, Fed. Rep. of Germany

[21] Appl. No.: 644,007

[22] Filed: Aug. 24, 1984

[30] Foreign Application Priority Data

Aug. 26, 1983 [DE] Fed. Rep. of Germany ..... 3330771

[51] Int. Cl.[3] ..... F02M 45/02

[52] U.S. Cl. ..... 123/300; 123/514; 239/533.3; 239/88; 417/251

[58] Field of Search ..... 123/514, 516, 299, 300; 417/462, 251; 239/124, 125, 88–95, 533.1–533.12

[56] References Cited

U.S. PATENT DOCUMENTS

| | | | |
|---|---|---|---|
| 2,137,473 | 11/1938 | Makins | 239/533.3 |
| 2,173,814 | 9/1939 | Bischof | 123/300 |
| 2,317,618 | 4/1943 | King | 239/88 |
| 3,394,891 | 7/1968 | Voit | 123/299 |
| 3,403,861 | 10/1968 | Eidtmann et al. | 239/533 |
| 3,409,225 | 11/1968 | Maddalozzo | 239/91 |
| 4,022,165 | 5/1977 | Eckert | 123/300 |
| 4,289,098 | 9/1981 | Norberg et al. | 123/299 |
| 4,356,979 | 11/1982 | Eblen | 239/533.5 |
| 4,385,609 | 5/1983 | Kato | 239/88 |

FOREIGN PATENT DOCUMENTS

| | | | |
|---|---|---|---|
| 849325 | 12/1951 | Fed. Rep. of Germany | 123/300 |
| 2943895 | 5/1981 | Fed. Rep. of Germany | 123/300 |
| 3002851 | 7/1981 | Fed. Rep. of Germany | 123/300 |
| 541100 | 11/1941 | United Kingdom | 239/88 |

*Primary Examiner*—Carl Stuart Miller

*Attorney, Agent, or Firm*—Edwin E. Greigg

[57] ABSTRACT

A fuel injection apparatus having an auxiliary pump for pilot and main injections in internal combustion engines, in which a pilot injection quantity pumped by a low-pressure pump is stored ahead of a pilot injection piston embodied as a pressure piston, which is driven by a following but coaxially disposed intermediate piston, upon pumping by the high-pressure injection pump, and as a result positively displaces the pilot injection quantity. Both pistons are supported in an intermediate element between the connection piece of an injection valve and the nozzle holder of the valve. The intermediate element combines not only the elements for the auxiliary pump but also the leak-off bores from the nozzles with the leak-off removal means of the two-part stepped piston supported therein. The invention makes it possible to install the auxiliary pump in a double injection valve in a space-saving manner, without having to change the dimensions of the injection valve except for a slight lengthening, and as a result no changes need to be made in the engine or injection pump.

10 Claims, 3 Drawing Figures

FUEL INJECTION APPARATUS WITH AN AUXILIARY PUMP FOR PILOT AND MAIN INJECTION

BACKGROUND OF THE INVENTION

The invention is based on a fuel injection device as defined hereinafter. A fuel injection device of this kind is known, for instance from German Offenlegungsschrift No. 30 02 851, although this device is intended exclusively for an application where a primary fuel that is difficult to ignite pumped by a high-pressure injection pump, on the one hand, and on the other, an igniting fuel pumped by a separate pump are to be delivered via a hydraulically actuated auxiliary pump to separate injection nozzles, for the main fuel and the igniting fuel, in a Diesel engine. The low-pressure pump which furnishes the igniting fuel communicates with a pilot storage chamber in the auxiliary pump that is defined by an expulsion piston, and the supply pressure of the main fuel acts upon the remote side of the expulsion piston. Aside from the engineering expense necessary in order to provide each cylinder of the Diesel engine with separate injection valves for the pilot injection and the main injection, each with an auxiliary pump, and the many connecting lines needed for this, it is also problematical in the known apparatus to effect accurate control of the sequence of time between the pilot injection and the main injection, because the dead spaces existing in the connecting lines cause unavoidable deviations, particularly in accordance with rpm, from the specified control times for the pilot injection and the main injection.

An apparatus is also known (German Pat. No. 1 252 001) in which a separate, small piston for the pilot injection is disposed such that it is offset in an axially parallel manner from a loading piston for the main injection inside a fuel injection valve, although no separate low-pressure supply means is provided, and the pilot injection quantity is derived from the supply of fuel for the main injection. As a result, the standing pressure in the pressure line, and thus the accuracy of quantity control, are unfavorably affected.

Finally, it is also known (German Offenlegungsschrift No. 28 34 633), for controlling the pilot injection in internal combustion engines, to provide a one-piece control slide which is displaceable counter to the force of a spring, and which with a pronounced intermediate relief into a reservoir, via control edges, establishes the particular desired connections for the pilot injection and the main injection. Here again, the pilot injection quantity is diverted from the supply quantity of the injection pump that also furnishes the main injection quantity, so that once again the accuracy of the quantity control of the main injection quantity is affected negatively.

OBJECT AND SUMMARY OF THE INVENTION

The fuel injection apparatus having the characteristics disclosed herein has the advantage over the prior art that the auxiliary pump can be integrated inside a single injection valve having the conventional dimensions and a double needle nozzle for the pilot and the main injections in a space-saving manner, that is, without additionally having to provide a function block with several additional lines. In so doing, no changes in the motor or the injection pump are necessary.

It is also advantageous that the inlet or check valve in the supply line from the low-pressure pump is disposed near the spring chamber of the pressure piston that is responsible for the pilot injection, so that the dead volume is kept small, and also that the injection valve can be used without alteration for two-fuel injection as well.

A particularly advantageous feature of the fuel injection apparatus according to the invention is the division of the piston system for the pilot injection into a two-part stepped piston having an intermediate piston and a pressure piston disposed axially with respect to one another, each piston having its own restoring spring in spring chambers which are kept small in size.

The invention will be better understood and further objects and advantages thereof will become more apparent from the ensuing detailed description of two preferred embodiments taken in conjunction with the drawings.

DESCRIPTION OF THE PREFERRED EMBODIMENTS

The basic concept of the present invention is to dispose the stepped piston, divided in two, in an axial in-line arrangement inside the injection valve, preferably with separate spring chambers for each piston.

Figure 1:
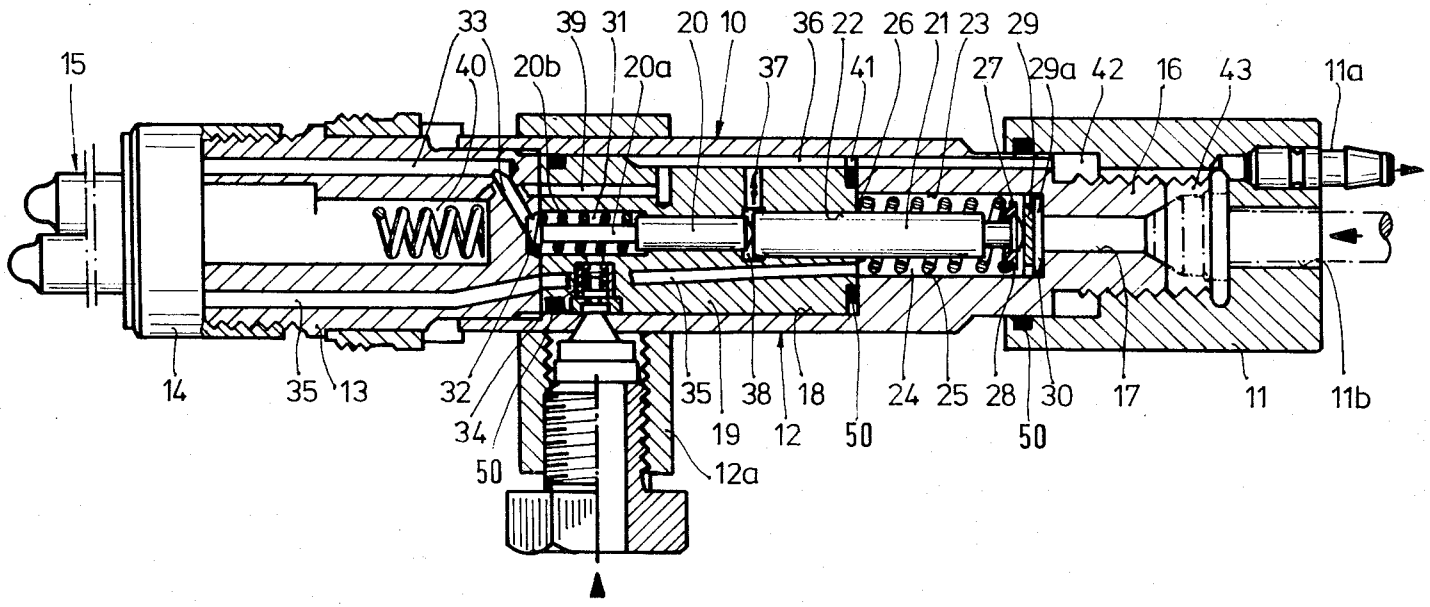
FIG. 1 shows the fuel injection apparatus according to the invention, integrated in a double injection valve, in cross section.

The injection valve 10 shown in FIG. 1, having a double needle nozzle and an auxiliary pump for pilot injection, includes a connection piece 11 with a leak—off and relief connection 11*a* and the pressure line connection 11*b* to the high-pressure injection pump; an integrated auxiliary pump intermediate element 12 having the dimensions of the injection valve, which also includes the low-pressure connection 12*a* communicating with a low-pressure fuel feed pump; and farther along, a nozzle holder 13 secured to the intermediate element 12 and having a nozzle body with a sleeve nut, the nozzle body being merely suggested at 14, forming a double needle nozzle as shown at 15. A double needle nozzle of this kind is known, for instance from German Offenlegungsschrift No. 29 43 895; furthermore, known double needle nozzles having coaxial valve needles and separate compression chambers (as in German Pat. No. 849 325) can be equipped with an auxiliary pump in accordance with the present invention. The intermediate element 12 screwed into the connection piece 11 is embodied as a hollow cylinder with a stepped inner bore; with an extension 16 having a central fuel delivery conduit 17, it protrudes into the connection piece 11 and itself supports an insert 19 in a lower, enlarged bore 18. The stepped piston divided into two parts and provided for pilot injection comprises a pressure piston 20 and an intermediate piston 21, which are slidable and are axially in line with one another, is disposed in the insert 19 in a central, stepped inner bore thereof. The intermediate piston 21 protrudes out of its piston guide provided at 22 in the insert 19 into its spring chamber 24 formed in the intermediate element 12 by an inner bore 23 which is enlarged in comparison with the delivery conduit 17. A biasing spring 25 is supported at one end on the free end face of the insert 19 at 26 and on the other end on a spring ring 28 secured to a cap-like protrusion 27 of the intermediate piston 21. An adjusting plate 29 is disposed as a stop between the protrusion 27 and the extension, which forms a shoulder 30, between the inner bore 23 and the conduit 17. The pilot injection quantity $Q_{VE}$ is determinable by means of the thickness of this adjusting plate 29. Grooves 29*a* in the adjusting plate 29 permit the fuel to flow unhindered from the conduit 17 to the spring chamber 24.

The pressure piston 20 has its own spring chamber 31, which is formed in the insert 19 and like the spring chamber 24 of the intermediate piston is kept small in size; this spring chamber 31 is closed off by a recess 32 serving as the bore bottom in the end face of the contiguous nozzle holder 13. From this recess 32, a pilot injection pressure conduit 33 then leads through the nozzle holder 13 to the associated needle nozzle for the pilot injection. Since the embodiment of the nozzle holder 13 and the double needle nozzle 15 contiguous with it can be realized in a known manner, this need not be described in detail here. One essential feature of the present invention is, however, that the inlet 34 to the spring chamber 31 of the pressure piston 20, which is embodied with a check valve in the form of a flat seat valve, a cone valve or a ball valve, discharges directly into the spring chamber 31 from the connection 12*a*, so that the dead volume can be kept particularly small.

Beginning at the spring chamber 24 for the intermediate piston 21, the fuel pressure conduit 25 extends through the insert 19 and the nozzle holder 13, bypassing the inlet 34, to the associated needle nozzle for the main injection. Sealing discs 50 are disposed between the various parts for sealing purposes. The leak-off conduit 36 formed laterally between the insert 19 and the intermediate element 12 discharges via a first transverse bore 37 into a connecting chamber 38 of enlarged diameter in the insert 19, in which the pressure piston 20 and the intermediate piston 21 adjoin one another, and also discharges via further connecting conduits 39 into the spring chamber, which receives springs for the valve needles and is merely suggested schematically at 40, in the nozzle holder 13. A means of leak-off communication with the leak-off conduit 36 is also provided at 41 at the transitional sealing region between the insert 19 and the intermediate element 12, as well as at the point of discharge of the leak-off conduit 39 into an annular chamber 42 in the connection piece 11, and from there a connecting conduit 43 leads to the leak-off connection 11*a*.

The apparatus accordingly has the following mode of operation:

Once the fuel, under pressure from the high-pressure injection pump, reaches the connection 11*b*, then it impacts upon the effective surface area of the intermediate piston 21, which displaces counter to the pressure of its biasing spring 25 and transmits this displacement to the pressure piston 20, until the piston-rod-like extension 20*a* thereof strikes the bottom of the recess 32 for limiting purposes. The fuel thus is positively displaced out of the spring chamber 31, and additionally counter to the pressure of the biasing spring 20*b* assigned solely to the pressure piston 20, thus represents the pilot injection quantity, which travels via the pressure conduits 33 to the associated needle nozzle. It is also understood that the check valve in the inlet 34 closes simultaneously with the increase in pressure in the spring chamber 31.

The main injection then takes place, in timed succession after this pilot injection and also in response to the retreating intermediate piston 21 and the pressure drop effected thereby, via the fuel delivery conduit 35 leading to the associated needle nozzle. The timed relationship or sequence that may be desired, and with a well-defined intermediate relief taking place as well, can be attained in the desired manner by appropriately dimensioning the effective biasing spring pressures, and also in terms of the opening pressures of the needle nozzles and the effective pressure surface areas.

Figure 2:
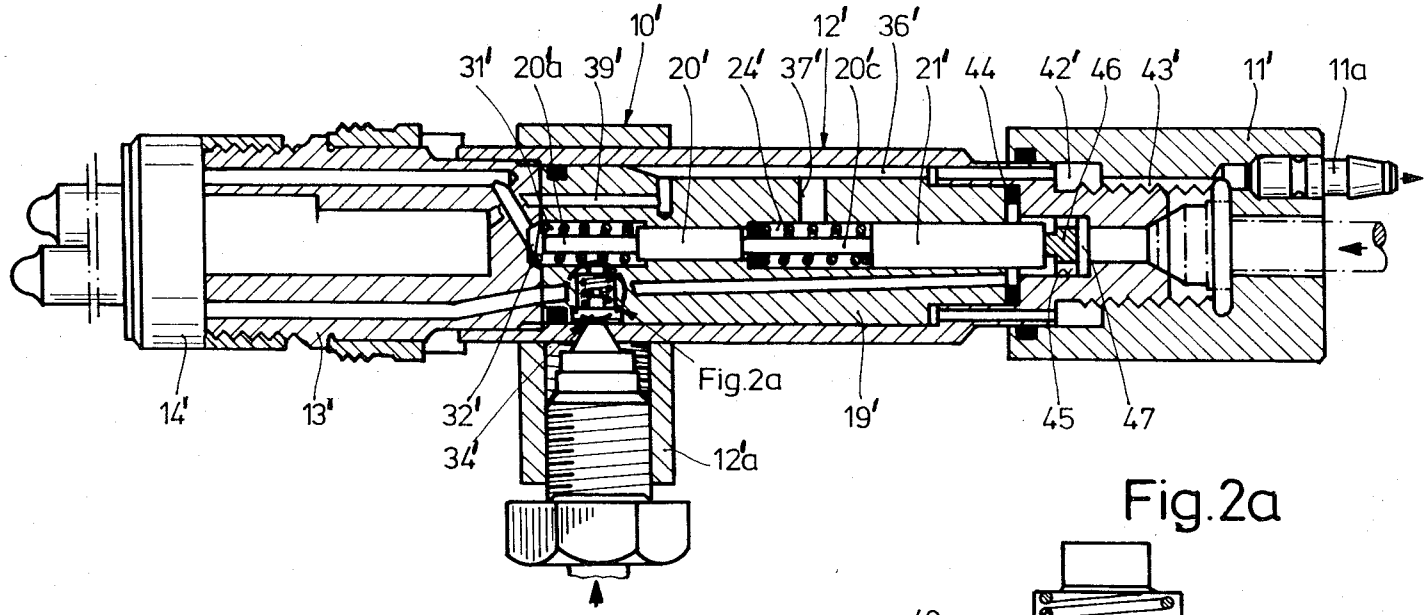
FIG. 2 shows a variant of the embodiment of FIG. 1, again in cross section.

In the exemplary embodiment shown in FIG. 2, the only difference from FIG. 1 is the region having the intermediate element, so elements identical to those of FIG. 1 and having the same functions are identified by the same reference numerals, distinguished merely by a prime. The insert 19' in the intermediate element 12' is extended farther upward and in its center it contains the bores, differing only slightly in diameter, for the coaxial pressure piston 20' and intermediate piston 21'. The spring chamber 24' for the intermediate piston 21' is disposed following the intermediate piston 21' and no longer surrounds it in an annular manner in its upper portion, as in the embodiment of FIG. 1. Since the spring chamber 24' is now located in the transitional region between the pressure piston 20' and the intermediate piston 21', it is pressure-relieved via a transverse bore 37' in favor of the leak-off conduit 36', and the pressure piston 20' has a piston-rod-like extension 20'*a* and 20'*c* at each end, the latter extension 20'*c* extending centrally through the spring chamber 24' of the intermediate piston 21' and resting on the posterior face thereof. Alternatively, the extension 20'*c* may be an integral part of the intermediate piston 21', which in that case then rests on the associated posterior face of the pressure piston 20'. In this exemplary embodiment, the limitation of the stroke is again effected by the striking of the bottom of the recess 32' in the nozzle holder 13' by the extension 20'*a*, while the stroke itself is determined by means of an adjusting and sealing plate 44 in the transitional region between the insert 19' and the intermediate element 12' cylindrically surrounding the insert 19'. As a result, the spacing between the upper stop face of the intermediate piston 21' and a stationary head element 46 that is pressed into the bore bottom 45 can be varied. The head element 46 has appropriate conduits 47 passing through it for the fuel pumped by the high-pressure injection pump.

Figure 2A:
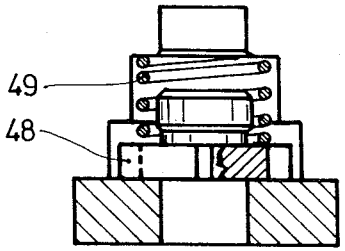
FIG. 2*a*, on an enlarged scale, shows a detail of one possible form of embodiment of the check valve in the supply line from the low-pressure pump.

The check valve shown on an enlarged scale in FIG. 2*a* in the inlet 34 or 34' of the low-pressure pump (pumping pressure of 2 bar, for example) has a movable valve body 48 with a biasing spring 49 which acts in the closing direction.

The foregoing relates to preferred exemplary embodiments of the invention, it being understood that other variants and embodiments are possible within the spirit and scope of the invention, the latter being defined by the appended claims.

What Is claimed and desired to be secured by Letters Patent of the the United States is:

1. A fuel injection apparatus having an auxiliary pump for pilot and main injections in internal combustion engines, wherein a pilot injection quantity pumped via an inlet by a low-pressure pump is stored ahead of a pilot injection piston and is positively displaced to an injection nozzle by said last named piston, upon said piston being driven by the supply pressure of a high-pressure injection pump, characterized in that said pilot injection piston further includes a pressure piston and is driven by a coaxially disposed intermediate piston with each of said pistons being disposed in a cylindrical intermediate element provided with pressure lines and leak-off lines of said auxiliary pump, that said intermediate element being disposed between a connection piece and a nozzle holder is provided with a double needle nozzle, and further that said intermediate element has an outer dimension which does not exceed the diameter of the injection nozzle comprising an injection valve.

2. A fuel injection apparatus as defined by claim 1, further wherein said intermediate element includes stepped inner bores, to provide slide bearing guides for said intermediate piston and said pressure piston and correlated spring chambers associated with each said piston, and further wherein said leak-off lines of said nozzles are combined, via intermediate conduits, with a leak-off removal means and said respective pistons.

3. A fuel injection apparatus as defined by claim 1, further wherein said inlet from the low-pressure pump being disposed on said intermediate element at the level of said spring chamber is associated in proximity to said pressure piston.

4. A fuel injection apparatus as defined by claim 1, further wherein said intermediate element comprises a cylindrical sleeve arranged to surround an insert said sleeve being threaded at one end into said connection piece of said injection valve.

5. A fuel injection apparatus as defined by claim 2, further wherein said intermediate element comprises a cylindrical sleeve arranged to surround an insert said sleeve being threaded at one end into said connection piece of said injection valve.

6. A fuel injection apparatus as defined by claim 5, further wherein said insert comprises said slide guides for said pressure piston and said intermediate piston and said spring chamber for said intermediate piston is embodied by a continuing, enlarged inner bore of said sleeve and wherein said inner bore has a stroke-limiting adjusting plate for a pilot injection quantity.

7. A fuel injection apparatus as defined by claim 1, further wherein said pressure piston and said intermediate piston are associated with a transitional region which communicates with said leak-off lines.

8. A fuel injection apparatus as defined by claim 7, further wherein said transitional region is provided with a coaxial spring disposed between said pressure piston and said intermediate piston and a pressurerelieving transverse bore discharges into said spring chamber.

9. A fuel injection apparatus as defined by claim 4, further wherein said leak-off lines extend peripherally between said insert and said cylindrical sleeve and leads via further transverse and longitudinal conduits as far as a spring chamber provided in said nozzle holder.

10. A fuel injection apparatus as defined by claim 5, further wherein said leak-off lines extend peripherally between said insert and said cylindrical sleeve and leads via further transverse and longitudinal conduits as far as a spring chamber provided in said nozzle holder.

* * * * *

UNITED STATES PATENT AND TRADEMARK OFFICE

CERTIFICATE OF CORRECTION

PATENT NO. : 4,524,737

DATED : 6/25/85

INVENTOR(S) : Eberhard Hofmann

It is certified that error appears in the above-identified patent and that said Letters Patent are hereby corrected as shown below:

Page 1, column 1, line (75):

Eberhard Hofman should be Eberhard Hofmann

Signed and Sealed this

*Fifteenth* Day of *October 1985*

[SEAL]

*Attest:*

DONALD J. QUIGG

*Attesting Officer*

*Commissioner of Patents and Trademarks—Designate*